US007743637B2

(12) United States Patent
Schlayer et al.

(10) Patent No.: US 7,743,637 B2
(45) Date of Patent: Jun. 29, 2010

(54) ROLLING TOOL WITH INTEGRATED DRAWING STAGE

(75) Inventors: Dietmar Schlayer, Vogt (DE); Hans-Joachim Pieperhoff, Wiesbaden (DE); Frank Beig, Bodnegg (DE); Norbert Ziesel, Waldburg (DE)

(73) Assignee: Mueller Weingarten AG, Weingarten (DE)

( * ) Notice: Subject to any disclaimer, the term of this patent is extended or adjusted under 35 U.S.C. 154(b) by 5 days.

(21) Appl. No.: 12/187,509

(22) Filed: Aug. 7, 2008

(65) Prior Publication Data

US 2009/0049880 A1 Feb. 26, 2009

Related U.S. Application Data

(63) Continuation of application No. PCT/DE2007/000264, filed on Feb. 9, 2007.

(30) Foreign Application Priority Data

Feb. 16, 2006 (DE) ..... 10 2006 007 501

(51) Int. Cl.
*B21D 22/00* (2006.01)

(52) U.S. Cl. ..... 72/348; 72/43; 72/213; 72/224; 72/370.21

(58) Field of Classification Search ..... 72/76, 72/212, 213, 224, 343, 347, 348, 349, 352, 72/370.21, 43, 44, 45, 206, 41, 75; 184/6.14
See application file for complete search history.

(56) References Cited

U.S. PATENT DOCUMENTS

| | | | | |
|---|---|---|---|---|
| 2,145,125 | A * | 1/1939 | Moore | 72/206 |
| 2,751,872 | A | 6/1956 | Hodes | |
| 3,360,157 | A | 12/1967 | Bolt et al. | |
| 3,572,271 | A * | 3/1971 | Fraze | 72/352 |
| 3,729,970 | A | 5/1973 | Propach et al. | |
| 3,733,880 | A * | 5/1973 | Hansson | 72/344 |
| 3,796,085 | A | 3/1974 | Fisher et al. | |
| 3,796,106 | A | 3/1974 | Fisher et al. | |
| 3,983,733 | A * | 10/1976 | Davis | 72/213 |
| 5,524,465 | A * | 6/1996 | Kajiwara et al. | 72/42 |
| 5,782,123 | A * | 7/1998 | Vakiparta | 72/75 |
| 5,794,475 | A * | 8/1998 | Schuppler et al. | 72/213 |
| 5,862,700 | A | 1/1999 | Klein | |
| 5,865,055 | A * | 2/1999 | Morozumi | 72/224 |
| 5,953,947 | A * | 9/1999 | Klein | 72/213 |
| 6,250,120 | B1 * | 6/2001 | Osgood et al. | 72/43 |
| 6,470,723 | B2 * | 10/2002 | Sumitomo et al. | 72/75 |
| 6,622,570 | B1 * | 9/2003 | Prevey, III | 73/826 |

FOREIGN PATENT DOCUMENTS

| | | | |
|---|---|---|---|
| DE | 1 527 908 | A | 1/1970 |
| DE | 2 017 709 | A1 | 11/1971 |
| DE | 2 225 466 | A1 | 1/1973 |
| DE | 196 39 081 | C2 | 6/2003 |
| DE | 103 17 506 | A1 | 11/2004 |
| JP | 2003-191025 | A1 | 7/2003 |

* cited by examiner

*Primary Examiner*—Edward Tolan
(74) *Attorney, Agent, or Firm*—Burr & Brown

(57) ABSTRACT

The invention relates to a method and a tool for producing cylindrical workpieces having longitudinal grooves, wherein the actual rolling operation is preceded by a drawing stage integrated in the tool and wherein the forming rollers are realized with an improved mounting.

10 Claims, 3 Drawing Sheets

ROLLING TOOL WITH INTEGRATED DRAWING STAGE

CROSS REFERENCE TO RELATED APPLICATIONS

This application is a continuation of International Application No. PCT/DE2007/000264, filed Feb. 9, 2007, which designated the United States, and claims the benefit under 35 USC §119(a)-(d) of German Application No. 10 2006 007 501.3 filed Feb. 16, 2006, the entireties of which are incorporated herein by reference.

FIELD OF THE INVENTION

The invention relates to a rolling method and a tool for producing cylindrical workpieces having longitudinal grooves, by means of forming rollers having an improved mounting. In addition, the actual rolling operation is to be optionally preceded by a drawing stage integrated in the tool.

BACKGROUND OF THE INVENTION

In the production of profiled pieces such as, for example, clutch disk-carriers, toothed-belt disks or similar workpieces having a basic cylindrical structure, high levels of accuracy and precision are frequently required. In particular, the accuracy and the surface quality are important.

The workpieces described are high-grade production parts which in some cases are produced in large quantities. Thus, in the case of a production installation for such workpieces, the costs and the output are also important criteria, in addition to the qualitative characteristics.

DE 20 17 709 A1 describes a method suitable for the production of the workpieces described above. A special rolling tool enables the workpiece to be produced from a raw piece having a smooth outer contour by means of a press, each press stroke forming a workpiece out of a raw piece. Upon each press stroke there is executed a rolling operation in which the profiling rollers impress the desired outer profile into the circumferential surface of the workpiece. The profiling rollers in this case are arranged in a lower die along the circumference of the workpiece to be worked. When the workpiece is pressed between the rollers by means of an upper die attached to the press ram, these rollers are supported on support rollers having corresponding mounting.

The lower die can be of a rotationally symmetrical structure, the individual profiling rollers that produce the profile of the workpiece being distributed regularly and at a uniform angle in relation to one another along the circumference of the workpiece. Consequently, and owing to the resultant rotationally symmetrical apportioning of forces during a forming operation, the individual grooves produced by the respective profiling rollers are practically like one another. In particular, an offset-free contour is achieved.

The disadvantage of the method is that a raw piece that has been preformed to be close to contour has to be readily available before the rolling procedure. This means that the raw piece must be produced in a separate forming procedure, for example a drawing procedure. A further disadvantage in the embodiment described above is in the structural design of the profiling roller support by means of the support rollers. Although this embodiment renders a profiling roller diameter of reduced size, it is structurally very complex and cost-intensive because of the arrangement of the support rollers. In addition, the tool has a large overall height as a result.

SUMMARY OF THE INVENTION

The invention is based on the object of developing a method and a tool in which both the forming of a blank to produce a raw piece and the forming on the raw piece by rolling are attained in a common apparatus during one press stroke. In addition, the overall height of the tool is to be reduced through a new type of profiling roller mounting.

The invention is based on the concept of using the downwardly directed stroke of a forming press for a combined forming operation, consisting of deep-drawing and forming by rolling, within one tool. An advantageous result in this case is that the overall height of the tool part provided for forming by rolling is significantly reduced by a new type of profiling roller mounting. The mounting of the profiling rollers consists of two bearing shell halves, which cover the profiling rollers on the majority of the circumferences of the profiling rollers. The profiling rollers project out of the bearing shell halves on the side facing towards the workpiece. Lubricant is entered between the profiling rollers and the bearing shells via a pressure-feed lubrication. The two bearing shell halves are preferably realized as solid bearing shell halves and with an overall height that is only slightly higher than the circumference of the profiling rollers. This enables a drawing ring to be mounted in the upper region of the tool. This drawing ring, together with the upper part of the die, which is fixedly connected to the ram, performs the function of deep-drawing from a flat blank the cylindrical raw piece that is required for the rolling operation. This is preferably performed without a plate holder. The structure of the tool, however, also allows the drawing operation to be performed by means of an additionally installed plate holder.

Owing to the small overall height of the tool according to the invention, it is also conceivable for a plurality of roller sets to be installed in the stroke direction, and consequently the operation of forming by rolling can be effected in multiple stages.

BRIEF DESCRIPTION OF THE DRAWINGS

Further details and advantages of the invention are evident from the exemplary embodiment represented in the drawings.

DETAILED DESCRIPTION OF THE INVENTION

Figure 1:
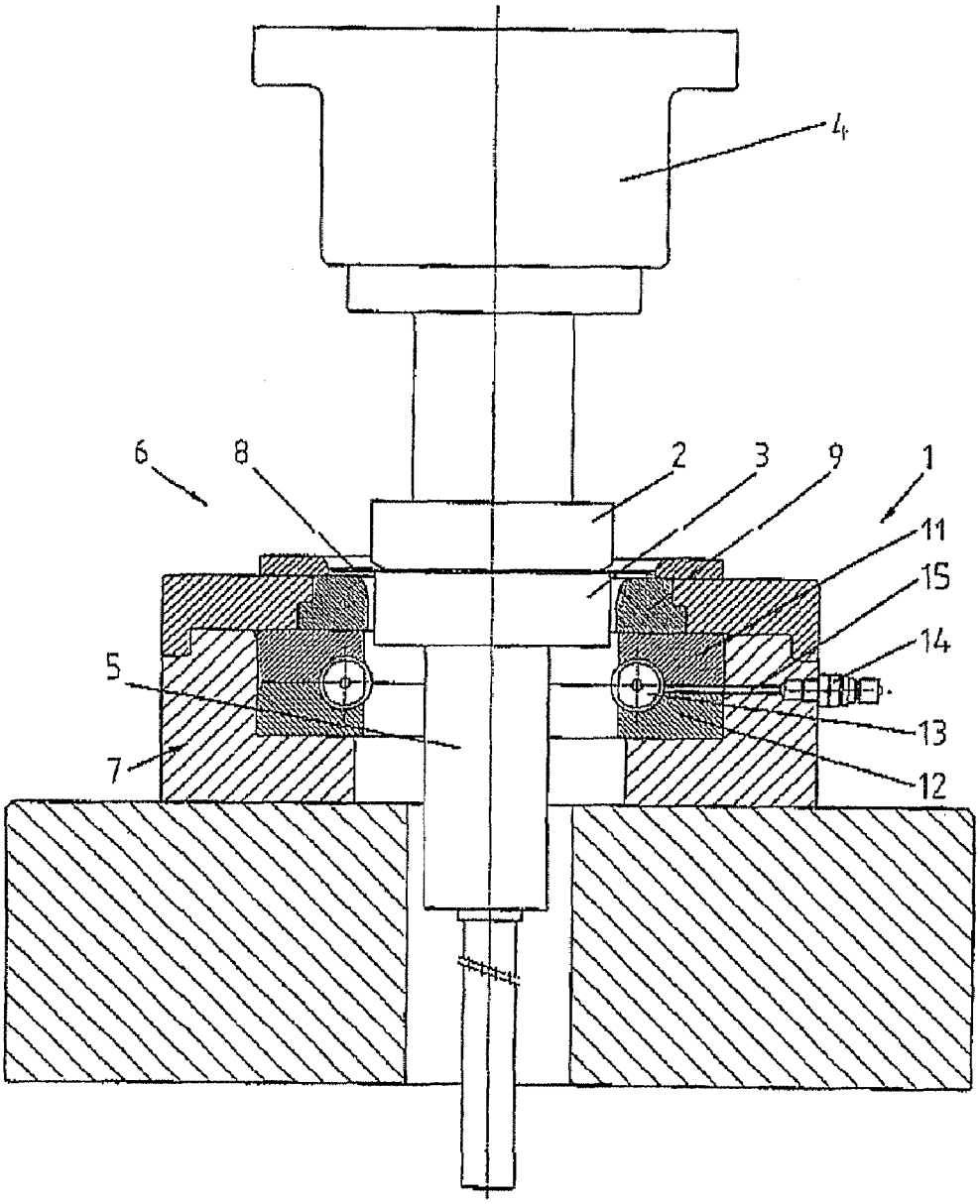
FIG. 1 shows a tool with die and blank at the start of the deep-drawing operation.

FIG. 1 shows a sectional representation of the tool 1 according to the invention. The tool 1 consists of a drawing unit 6 and a rolling unit 7. The drawing unit 6, in turn, consists of a die upper part 2, which is fixedly connected to the ram 4, and of a die lower part 3, which can be moved vertically via the lifting unit 5.

FIG. 1 shows the position at the start of the drawing operation. The ram 4, with the die upper part 2, has already moved downwards to such an extent that the forming of the blank 8 can commence. In this case, the blank 8 is drawn downwards via the drawing ring 9. The die lower part 3 is displaced downwards. Owing to the contour of the die upper part 2 and the design of the drawing ring 9, after the drawing operation there is produced a raw piece 10 which serves as a basic form for the subsequent operation of forming by rolling.

Figure 2:
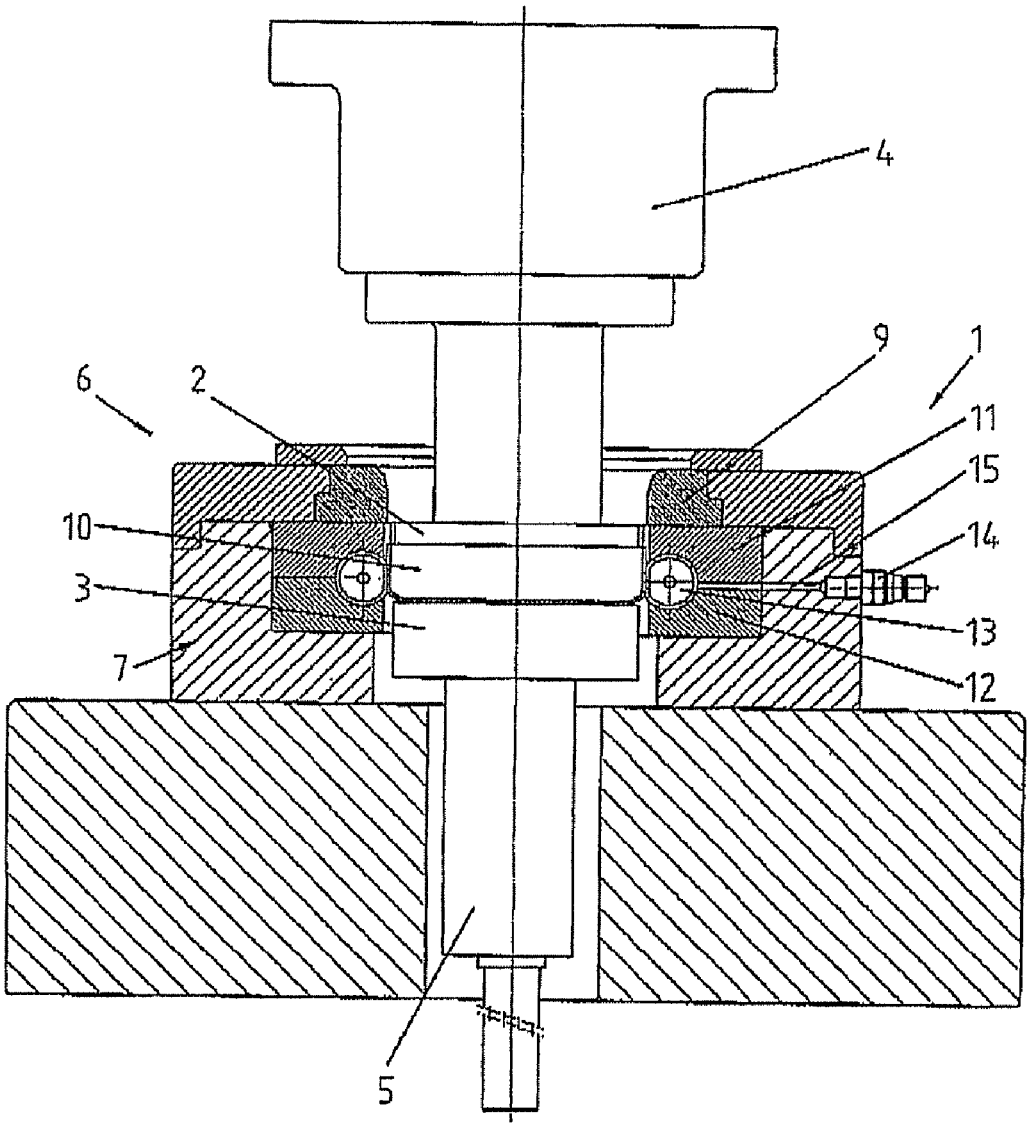
FIG. 2 shows a tool with die and raw piece during the operation of forming by rolling.

FIG. 2 shows a position during the operation of forming by rolling. It shows the rolling unit 7, with the upper bearing shell 11 and the lower bearing shell 12. The two bearing shell halves 11, 12 serve to accommodate or mount the profiling rollers 13. These profiling rollers 13 are arranged in a distributed manner on the circumference of the rolling unit 7. The raw piece 10 is now taken past the profiling rollers by the vertical downward movement of the ram 4 with the die upper part 2, and thereby acquires, on the outer diameter, the longitudinal groove profile resulting from the arrangement of the profiling rollers. A lubricating connection 14 can be seen at the outer edge of the tool 1 according to the invention. Via this lubricating connection 14 and via the lubricating line 15, lubricant is forced between the bearing shell halves 11, 12 and the profiling rollers by means of a pressure-feed lubrication. This lubricant covers the profiling rollers 13 and enters the region in which the profiling rollers 13 are in engagement with the raw piece 10, passes back out of the bearing shells and is supplied to a lubricant circuit. The lubricant outlet in the forming region assists the operation of forming by rolling and results in improved quality of the rolling result.

After the forming operation, the ram 4, with the die upper part 2, moves back upwards, while the finish-formed workpiece is likewise moved upwards by means of the lifting unit 5. The finish-formed workpiece can then be grasped by an automation apparatus and transported further. After a new blank 8 has been inserted in the tool 1 according to the invention, the combined operation of drawing and forming by rolling can recommence.

Figure 3:
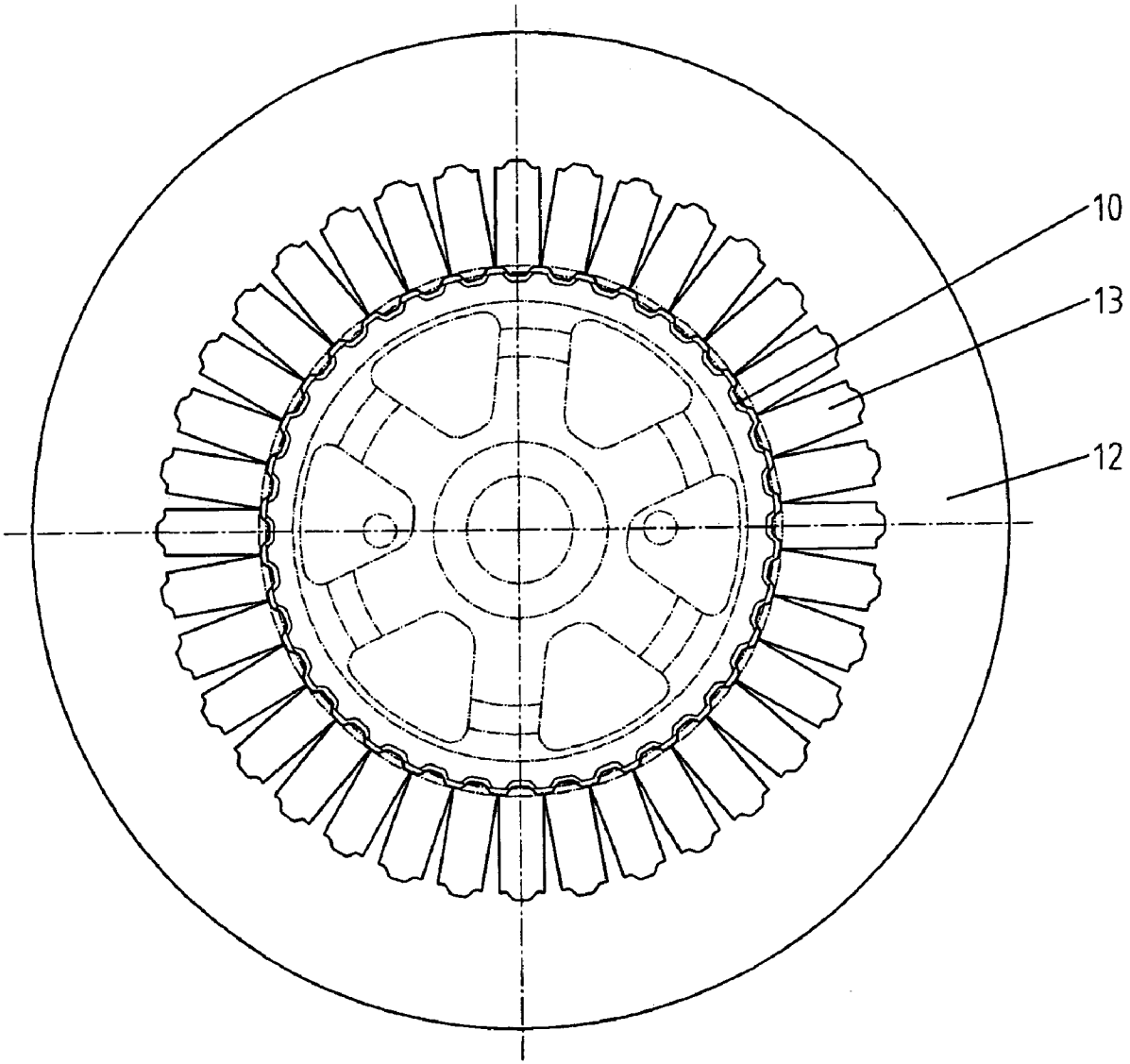
FIG. 3 shows a rolling unit, in a top view.

The arrangement of the profiling rollers 13 is shown clearly in FIG. 3. These profiling rollers are arranged in the circumference, corresponding to the final contour of the finish-formed workpiece. Also shown is the lower bearing shell 12, in which the profiling rollers 13 are mounted or guided.

The invention is not limited to the exemplary embodiment that is represented and described. It also includes all developments, by persons skilled in the art, within the scope of the concept according to the invention.

For example, as already mentioned, the rolling unit 7 can be arranged in multiples over one another, so as to thereby render possible multistage forming by rolling. It is likewise conceivable for the drawing unit to be additionally equipped with a controlled plate holder.

LIST OF REFERENCES

1 Tool
2 Die upper part
3 Die lower part
4 Ram
5 Lifting unit
6 Drawing unit
7 Rolling unit
8 Blank
9 Drawing ring
10 Raw piece
11 Upper bearing shell
12 Lower bearing shell
13 Profiling rollers
14 Lubricating connection
15 Lubricating line

We claim:

1. A method for producing a cylindrical workpiece having a profile on a circumference thereof comprising:

providing a tool comprising a drawing unit and a rolling unit, wherein the drawing unit consists of a die upper part which is fixedly connected to a ram and a die lower part, and the rolling unit consists of an upper bearing shell and a lower bearing shell accommodating concentrically arranged profiling rollers;

said method further sequentially comprising:

producing a raw piece from a flat blank by means of a forming procedure wherein the blank is drawn downwards via a drawing ring; and roll-forming the profile on the circumference of the workpiece by forcing the raw piece through the concentrically arranged profiling rollers using the ram whereby the raw piece is taken past the profiling rollers by the vertical downward movement of the ram with the die upper part;

wherein a lubricant inlet is provided in at least one rolling unit to force lubricant under pressure between the upper bearing shell and the lower bearing shell so as to directly contact a backside portion of the profiling rollers;

a lubricant outlet is provided in the at least one rolling unit; and the pressure fed lubricant is forced, via a lubricating line, between the bearing shells and the profiling rollers so that the lubricant covers the profiling rollers and enters the region in which a front side portion of the profiling rollers are in engagement with the raw piece, and wherein the steps of producing the raw piece and the roll-forming are performed using the same ram during a single downward stroke of the ram.

2. The method of claim 1, wherein the roll-forming procedure is effected in multiple stages by means of a plurality of rolling units arranged over one another.

3. A tool for producing cylindrical workpieces through the use of a roll-forming procedure, wherein a profile is produced on the circumference of a workpiece by means of concentrically arranged profiling rollers, wherein above at least one rolling unit there is a drawing unit, within which a blank is drawn by means of a die upper part, via a drawing ring, and wherein a lubricant inlet is provided in the at least one rolling unit to force lubricant under pressure between an upper bearing shell and a lower bearing shell so as to directly contact a backside portion of the profiling rollers, a lubricant outlet is provided in the at least one rolling unit, and the pressure fed lubricant covers the profiling rollers and an engagement area between the cylindrical workpieces and a front side portion of the profiling rollers.

4. The tool of claim 3, wherein a pressing force of the die upper part acts, via the blank, on a die lower part, which is forced downwards during the forming operation.

5. The tool of claim 3, wherein a plurality of rolling units are arranged over one another.

6. The tool of claim 3, further comprising a controlled plate holder for forming the blank.

7. The tool of claim 3, wherein after the forming operation, the workpiece is moved upwards by a lifting unit.

8. A tool for producing cylindrical workpieces though the use of a roll-forming procedure, said tool comprising:

a drawing unit consisting of a die upper part which is fixedly connected to a ram, and a die lower part;

at least one rolling unit consisting of an upper bearing shell and a lower bearing shell accommodating concentrically arranged profiling rollers;

a lubricant inlet provided in the at least one rolling unit to force lubricant under pressure between the upper bearing shell and the lower bearing shell so as to directly contact a backside portion of the profiling rollers; and a lubricant outlet provided in the at least one rolling unit, wherein the ram moves vertically downwards past a drawing ring for drawing a blank workpiece, wherein the pressure fed lubricant covers the profiling rollers and an engagement area between the workpiece and a front side portion of the profiling rollers, wherein the ram and the blank workpiece are then moved past the profiling rollers by the vertical downward movement of the ram to produce a profile on the circumference of the workpiece, and wherein the same ram moves past said drawing unit and said rolling unit during a single downward stroke of said ram.

9. The tool of claim 8, wherein lubricant is supplied between the bearing shell halves and the profiling rollers by means of a pressure-feed lubrication, via a lubricating line.

10. The tool of claim 9, wherein the lubricant supplied between the bearing shell halves and the profiling rollers emerges in the region in which the profiling rollers are in forming engagement with the workpiece.

* * * * *